US005499880A

United States Patent [19]

Pickering et al.

[11] Patent Number: 5,499,880

[45] Date of Patent: Mar. 19, 1996

[54] PRINT HEAD INCLUDES DONOR GUIDE AND RECEIVER GUIDE

[75] Inventors: James E. Pickering, Holcomb; Werner Fassler, Rochester, both of N.Y.

[73] Assignee: Eastman Kodak Company, Rochester, N.Y.

[21] Appl. No.: 404,683

[22] Filed: Mar. 15, 1995

[51] Int. Cl.[6] ..... B41J 13/10

[52] U.S. Cl. ..... 400/642; 400/120.04

[58] Field of Search ..... 400/120.04, 608.3, 400/628, 642, 643, 645; 271/902

[56] References Cited

U.S. PATENT DOCUMENTS

| | | | |
|---|---|---|---|
| 4,527,470 | 7/1985 | Smithbaner et al. | 101/111 |
| 4,552,470 | 11/1985 | Yana et al. | 400/120 |
| 5,176,458 | 1/1993 | Wirth | 400/120 |

*Primary Examiner*—Ren Yan

*Attorney, Agent, or Firm*—Milton S. Sales

[57] ABSTRACT

A thermal printer, which is adapted to transfer an image from a donor web to a sheet of receiver medium, includes a thermal print head and a platen that together define a print nip. There are respective paths for the donor web and the sheet, and the paths converge in a forward direction, to a position at which they abut, before proceeding past the nip defined by the thermal head and the platen. A transport system moves the donor web and the sheet in the forward direction along their respective paths to the nip, whereat heat from the thermal head causes an image to be transferred from the donor web to the sheet between leading and trailing edges of the sheet. The transport system also moves the sheet in a reverse direction along its respective path. A loading guide surface directs the leading edge of the sheet between the loading guide surface and the platen, toward the nip during an initial loading stage. A rewinding guide surface directs the trailing edge of the sheet of receiver medium between the loading edge guide surface and the platen during movement of the sheet in the reverse direction.

10 Claims, 6 Drawing Sheets

PRINT HEAD INCLUDES DONOR GUIDE AND RECEIVER GUIDE

BACKGROUND OF THE INVENTION

1. Field of Invention

This invention relates generally to thermal printers having a transport system for moving a receiver medium and a dye-donor web past a thermal print head to transfer a dye image to the receiver medium; and more particularly to an improved media guide for such printers.

2. Background

Small platen thermal printers use a print head with individually addressable heating elements to transfer dye from a donor to a receiver. Color images are produced by printing one dye color on the receiver and then rewinding the receiver prior to printing another dye color. When all dye colors are printed, the completed print is ejected.

Referring to FIGS. 1 and 2, a prior art thermal printer 10 includes a print head assembly 12 and dye-donor web supply and take-up spools 14 and 16, respectively. The printer includes a roller platen assembly 18, a pair of dye receiver medium transport mechanism pinch rollers 20 and 22, and a dye receiver medium supply 24.

Normal thermal printer operations include loading dye receiver medium, printing information upon the dye receiver medium and ejecting the finished print. Each of these operations is fully described in commonly-assigned U.S. Pat. No. 5,176,458, which issued to H. G. Wirth on Jan. 5, 1993. The disclosure of that patent is hereby incorporated into this specification by reference.

Printer operation begins with a loading phase, in which print head assembly 12 moves to a loading position. A dye-donor web 26 and a sheet 28 of dye receiver medium advance along converging paths to a printing location, and print head assembly 12 is positioned in preparation for the printing operation.

As a sheet 28 of dye receiver medium advances, it moves along a guide 30 to follow a curved path toward a gap between print head assembly 12 and platen assembly 18. As the dye receiver medium moves into this gap, it contacts dye-donor web 26 and is guided toward dye receiver medium transport mechanism pinch rollers 20 and 22.

Once dye receiver medium 28 is firmly held by dye receiver medium transport mechanism pinch rollers 20 and 22, print head assembly 12 moves toward platen assembly 18, pressing dye-donor web 26 and dye receiver medium 28 against platen assembly 18 to form a sandwich for thermal printing.

When the loading phase is completed, printer 10 enters a printing phase, during which print head assembly 12 presses dye-donor web 26 and dye receiver medium 28 into platen assembly 18, and prints information on the dye receiver medium.

FIG. 2 is an enlarged view of the print head and roller platen assembly region of the prior art thermal printer shown in FIG. 1. Donor web 26 and receiver sheet 28 are sandwiched between print head assembly 12 and roller platen assembly 18 during printing. Receiver sheet guide 30 directs receiver sheet 28 toward the print head. Mechanical interference constraints on this design require receiver sheet guide 30 to end some distance from the nip between the print head and the roller platen assembly. To insure that receiver sheet 28 moves properly in a receiver media transport path, a portion of the receiver sheet must remain between guide 30 and platen assembly 18 during the entire printing process. Thus, the distance from the end of receiver sheet guide 30 to the nip represents the smallest trailing border that can be provided on a print in the print direction.

Print heads in thermal printers typically include electronics packages which must be protected from damage. Still referring to FIG. 2, a standard print head electronics package cover 32 is provided. Dye donor web 26 from the supply spool passes over a separate upstream donor guide 34 and across electronics package cover 32 before passing through the nip between the print head and the roller platen assembly. Dye donor web 26 and dye receiver sheet 28 move downstream from the nip, still pressed together, until they reach a donor-receiver separation guide 36. From this point, dye donor web 26 separates from dye receiver sheet 28, with the dye donor web continuing on to take-up spool 16 (FIG. 1) and dye receiver sheet 28 being delivered to an output tray 38 (also FIG. 1).

This typical thermal printer configuration has two problems. First, it restricts the minimum border dimension in the print direction to at least the distance between the end of receiver sheet guide 30 and the nip between print head assembly 12 and roller platen assembly 18. The second problem is that scratches can be produced by the end of receiver sheet guide 30 rubbing on the image surface of receiver sheets 28.

SUMMARY OF THE INVENTION

The present invention provides a modified print head electronics package cover that further guides the receiver sheets from the receiver sheet guide to the nip between the print head assembly and the roller platen assembly to minimize print border size in the print direction. This invention additionally eliminates scratches due to abrasion of receiver sheets by the end of the receiver sheet guide.

The invention additionally provides a dye donor web guide which is integrated with the print head electronics package cover, reducing the printer's part count. The integrated dye donor web guide also stretches the dye donor web to center the web on the print head, and to help eliminate image defects.

According to a feature of the present invention, a printer, which is adapted to produce an image on a sheet of receiver medium, includes a print head and a platen that together define a print nip. A path for a sheet of receiver medium leads in a forward direction to a position at which it proceeds past the nip defined by the head and the platen, whereat an image is produced on the sheet between leading and trailing edges of the sheet. A loading guide surface directs the leading edge of the sheet between the loading guide surface and the platen, toward the nip during an initial loading stage. A rewinding guide surface directs the trailing edge of the sheet between the loading edge guide surface and the platen during movement of the sheet in the reverse direction.

According to another feature of the present invention, a thermal printer, which is adapted to transfer an image from a donor web to a sheet of receiver medium, includes a thermal print head and a platen that together define a print nip. There are respective paths for the donor web and the sheet, and the paths converge in a forward direction, to a position at which they abut, before proceeding past the nip defined by the thermal head and the platen. A transport system moves the donor web and the sheet in the forward direction along their respective paths to the nip, whereat heat from the thermal head causes an image to be transferred from the donor web to the sheet between leading and trailing edges of the sheet. The transport system also moves the sheet in a reverse direction along its respective path. A loading guide surface directs the leading edge of the sheet between the loading guide surface and the platen, toward the nip during an initial loading stage. A rewinding guide surface directs the trailing edge of the sheet of receiver medium between the loading edge guide surface and the platen during movement of the sheet in the reverse direction.

According to a preferred embodiment of the present invention, the rewinding guide surface is curved; preferably cylindrical. The loading guide surface is positioned between the converging paths to guide the leading edge of the sheet to the nip. The rewinding guide surface is positioned between the converging paths to guide the trailing edge of the sheet to the loading guide surface. An upstream guide surface is provided for directing donor web toward the nip. The upstream guide surface is curved in a cross-track direction to the path of the donor web to keep the donor web centered in the path.

The invention and its various objects and advantages will become more apparent to those skilled in the art from the ensuing detailed description of the preferred embodiments presented below, the accompanying drawings, and the appended claims.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a dye-sublimation thermal printer, it will be noted that the invention can be used with other types of thermal printers.

Figure 1:
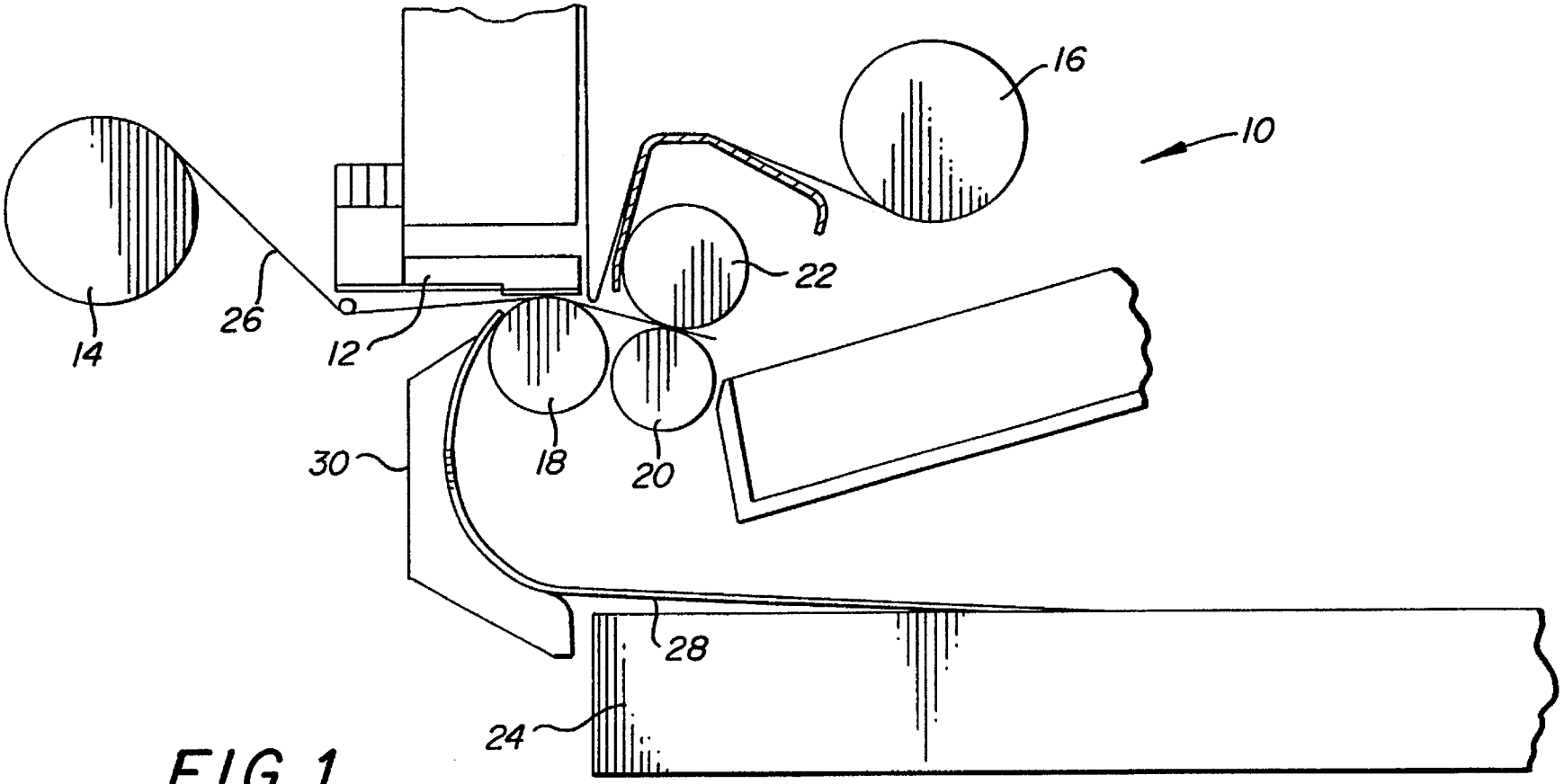
FIG. 1 ( PRIOR ART )
FIG. 1 is a side elevational view of a portion of a thermal printer according to the prior art, showing the print head and roller platen assembly region of the printer.
Figure 2:
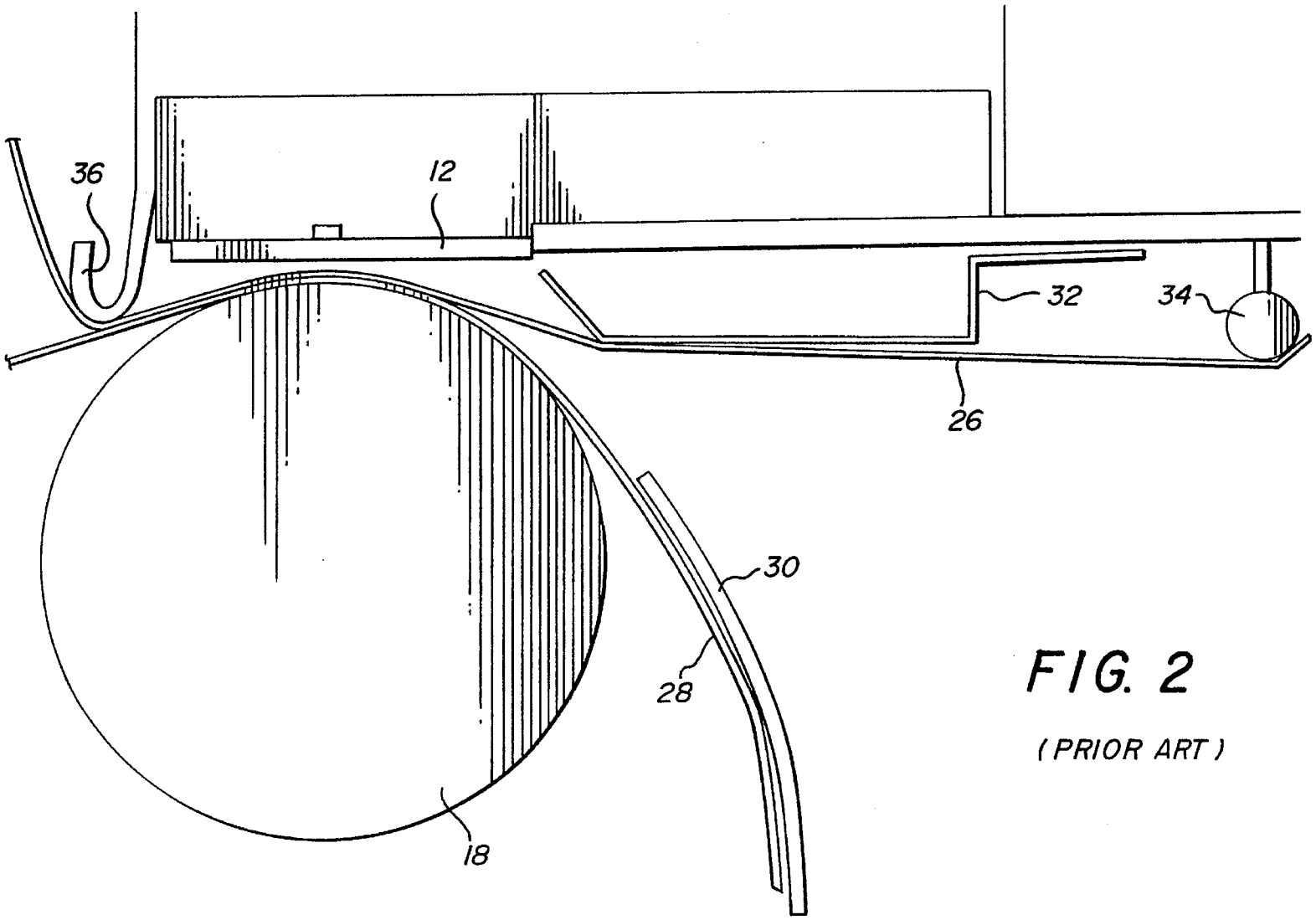
FIG. 2 (PRIOR ART)
FIG. 2 is an enlarged side elevational view of the prior art printer of FIG. 1 taken from the opposite side of the printer.
Figure 3:
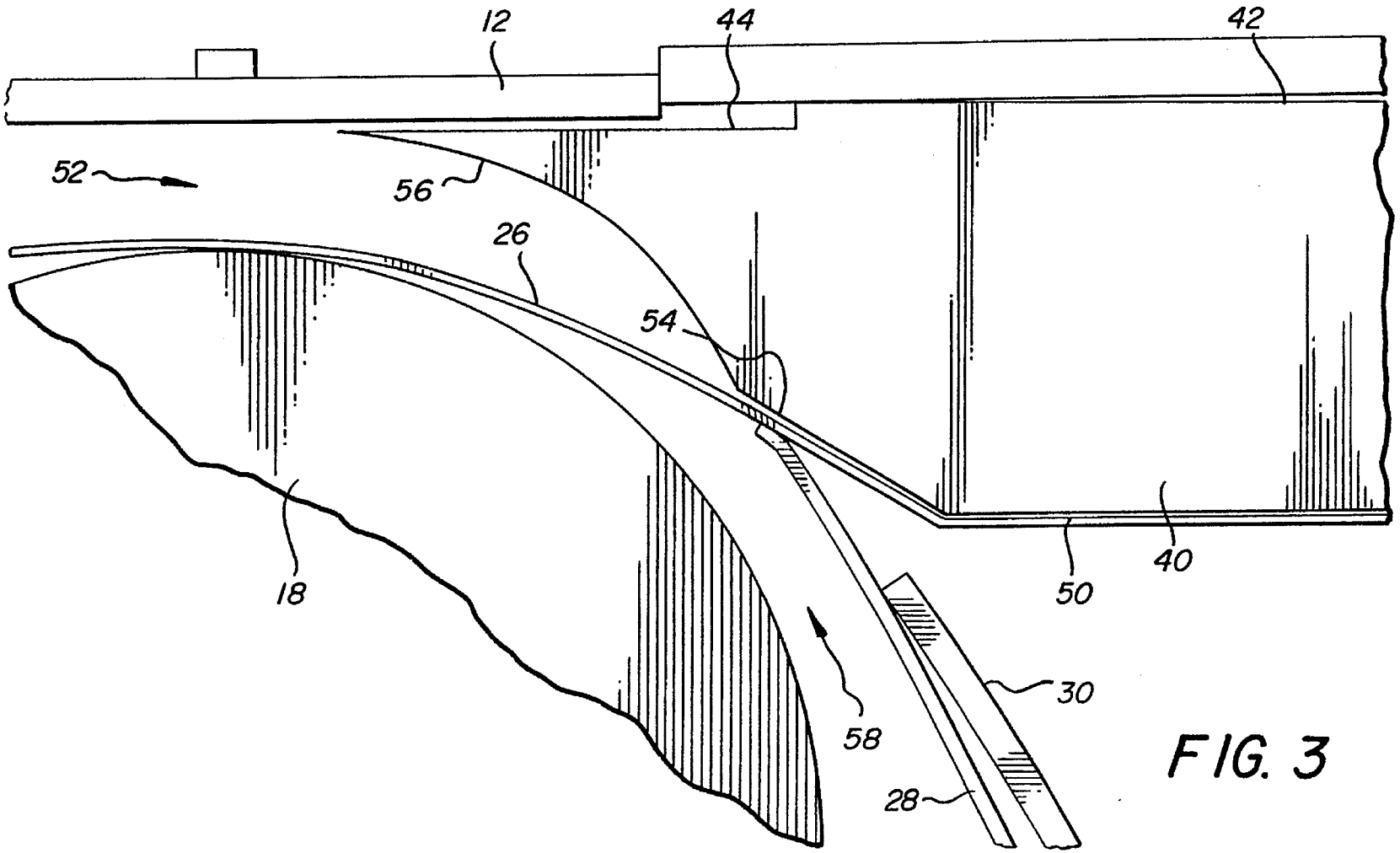
FIG. 3 is a view similar to FIG. 2 showing a portion of a thermal printer according to a preferred embodiment of the present invention with the dye donor web and the sheet of dye receiver medium in a loading operation configuration.
Figure 4:
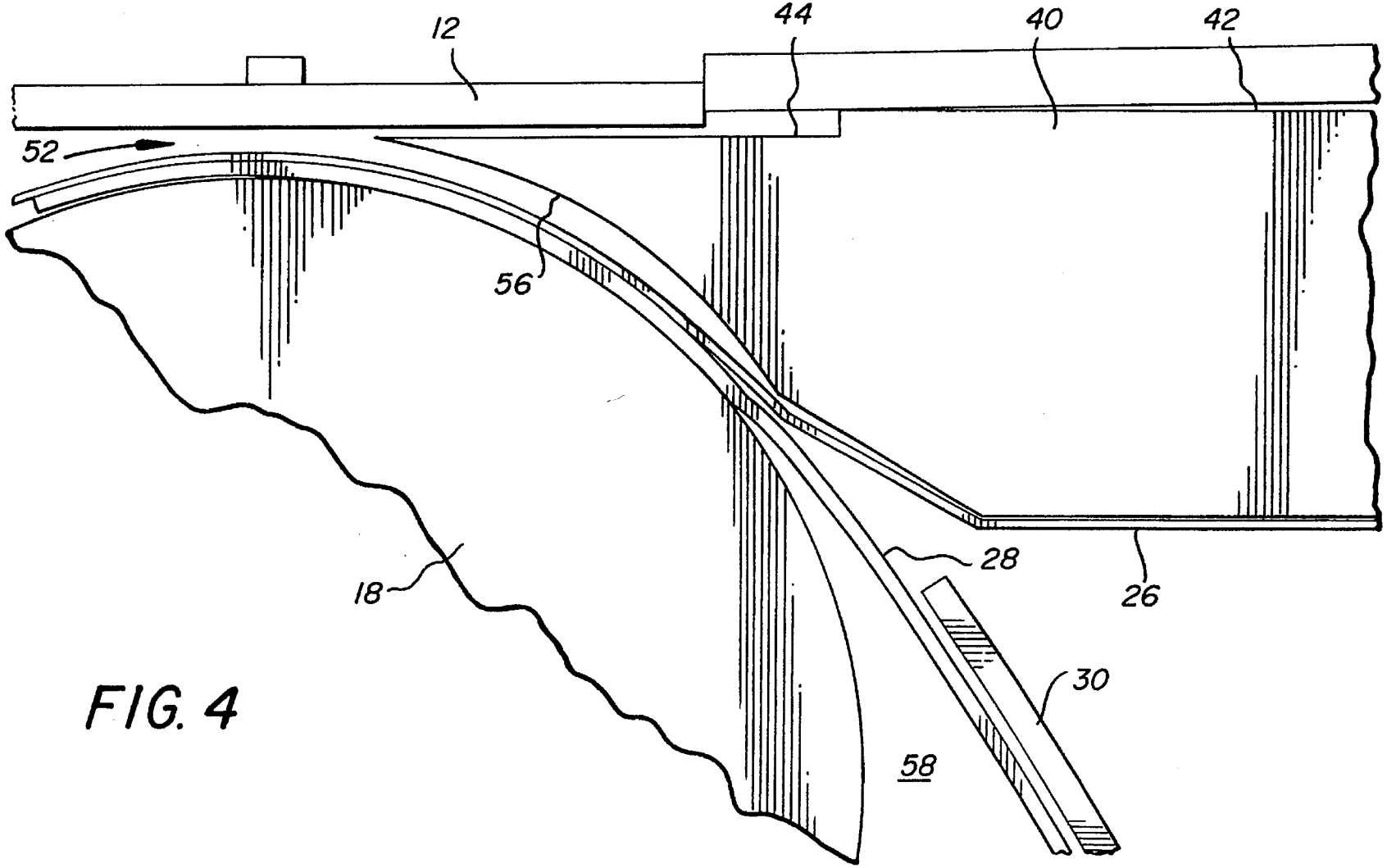
FIG. 4 is a view similar to FIG. 3, showing the printer parts during a printing operation.

The present invention replaces the prior art electronics package cover of FIGS. 1 and 2 with a modified electronics package cover 40, as shown in FIGS. 3-8. Electronics package cover 40 has several different surfaces which provide multiple features and functions, as hereinafter described.

Figure 5:
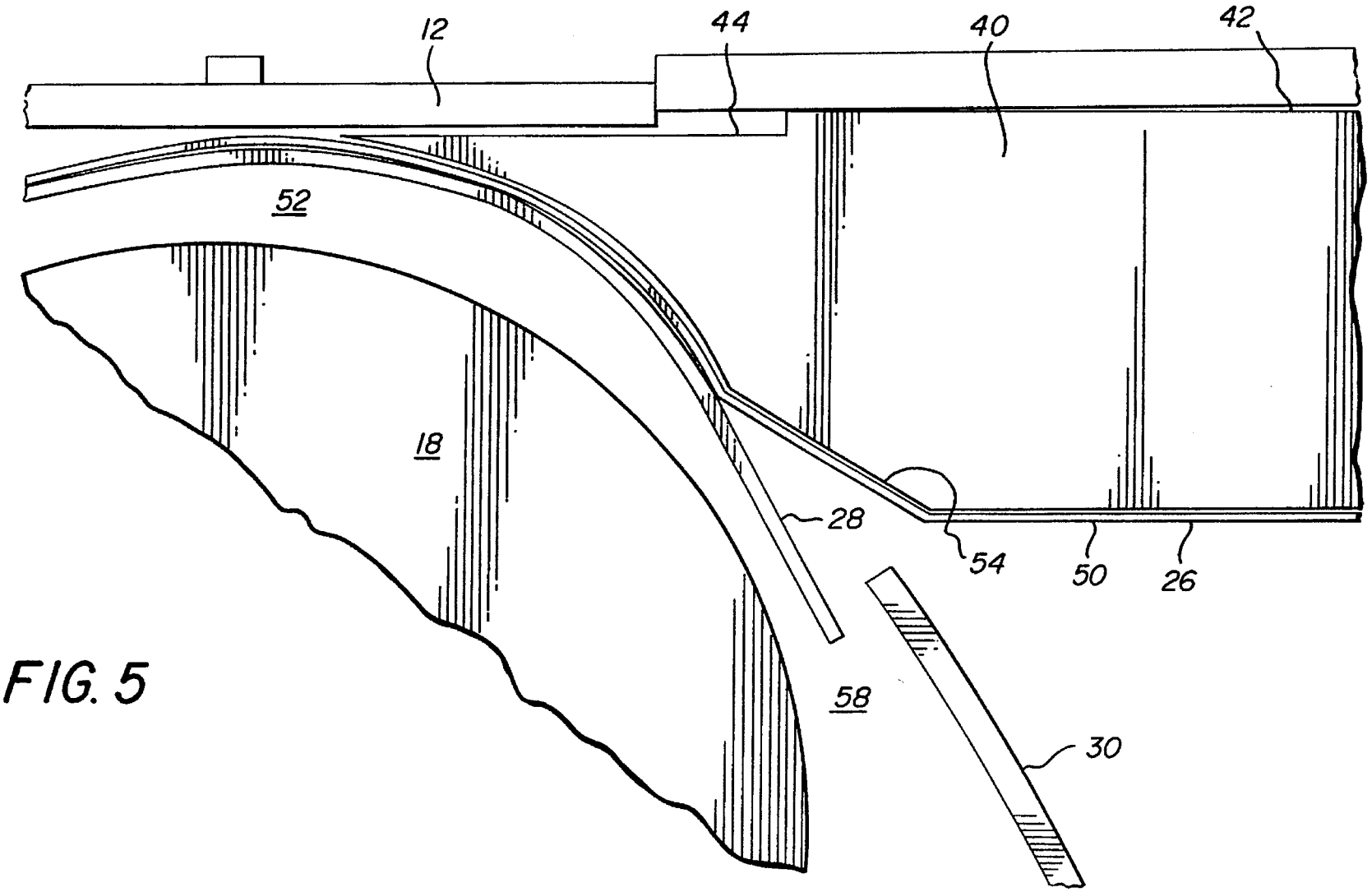
FIG. 5 is a view similar to FIG. 3, showing the printer parts during rewinding operation.

Electronics package cover 40 is preferably formed of a solid material such as plastic or metal that is mounted to the print head at a mounting surface 42. Hollow forms or a combination of multiple forms may also be used to construct electronics package cover 40. To insure that electronics package cover 40 does not damage the print head's print line, a downstream portion 44 of the electronics package cover is relieved. An upstream portion 46 of electronics package cover 40 may be similarly relieved as shown in FIG. 5. Electronics package cover 40 is mounted to print head assembly 12 using such techniques as screws through mounting holes 48 (FIG. 7) located in a surface 50.

During the loading operation (FIG. 3), print head assembly 12 is somewhat removed from roller platen assembly 18 to open a nip 52. Sheet 28 of dye receiver medium moves downstream from receiver sheet guide 30 toward the nip between print head assembly 12 and roller platen assembly 18. The edge of receiver sheet 28 encounters a loading guide surface 54 on electronics package cover 40, which directs the leading edge receiver sheet 28 toward nip 52. As receiver sheet 28 moves further downstream, donor web 26 helps guide the receiver sheet toward and through nip 52.

Loading guide surface 54 may be appropriately sized for the configuration of a given printer. In some printer designs, it is possible that the loading guide surface may be very small or even not included. Loading guide surface 54 may be a planar or a curved surface, as desired.

During the printing operation (FIG. 4), print head assembly 12 presses dye donor web 26 and dye receiver sheet 28 against roller platen assembly 18. Printing continues until the end of the image, which according to the present invention can be very close to the edge of dye receiver sheet 28. After a single-color image is printed, the direction of motion of dye receiver sheet 28 is reversed in preparation for printing a second single-color image over the first single-color image.

FIG. 5 shows the beginning of the reverse-direction operation. Print head assembly 12 and roller platen assembly 18 have moved apart to open nip 52. Receiver sheet 28 has begun to move in the upstream direction. Receiver sheet 28 has quickly encountered a rewinding guide surface 56 of electronics package cover 40. Rewinding guide surface 56 is preferably curved, and directs receiver sheet 28 into a gap 58 between the end of receiver guide 30 and roller platen assembly 18. This curve may be a simple cylindrical radius or a more complex shape. As receiver sheet 28 continues moving upstream, it is guided by rewinding guide surface 56 through gap 58, after which the receiver sheet follows receiver guide 30. When the sheet is properly positioned, another single-color printing operation can begin.

Figure 6:
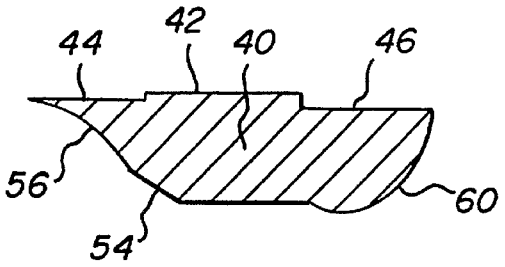
FIG. 6 is a cross-sectional view showing the modified electronics package cover, indicating its various surfaces.
Figure 7:
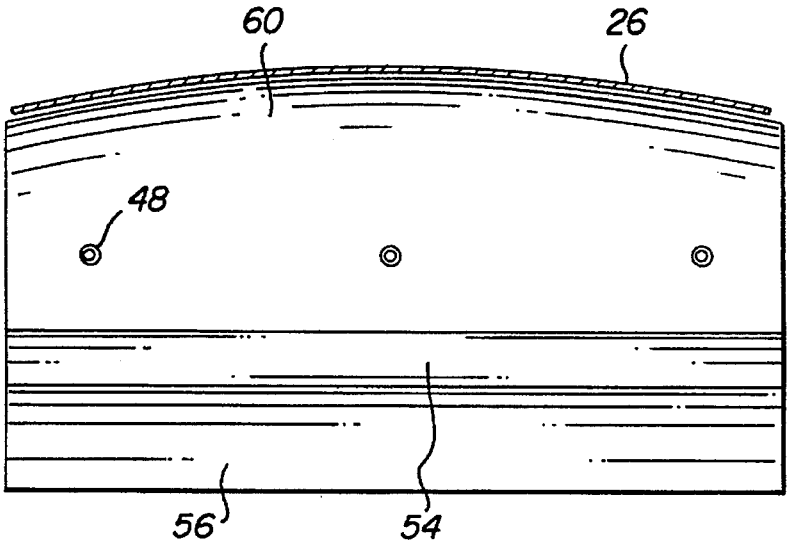
FIG. 7 shows a side view of the modified electronics package cover, as seen from the platen.
Figure 8:
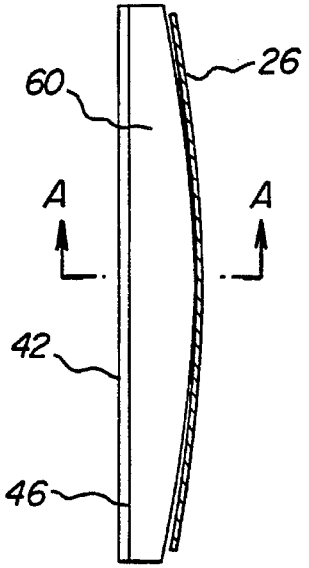
FIG. 8 shows another side view of the modified electronics package cover, as seen from the upstream side of the cover.

While the prior art printer of FIGS. 1 and 2 has an upstream surface 60 donor guide 34, an upstream surface 60 of electronics package cover 40 of the present invention is appropriately shaped to form a guide for dye donor web 26 to ride over. Upstream guide surface 60 (FIG. 6) of electronics package cover 40 can be a simple radius surface or it can have a more complex shape. FIG. 6 shows electronics package cover 40 in cross section; FIG. 7 provides a view of electronics package cover 40 in a plane containing the print line (the upstream-to-downstream and side-to-side plane);

and FIG. 8 shows modified electronics package cover 40 a plane that is perpendicular to FIG. 7 and which is parallel to the print line (the side-to-side and print head-to-platen plane).

The curved shape of upstream guide surface 60 keeps the donor aligned and centered on the print head. In addition, upstream guide surface 60 keeps dye donor web 26 taut to eliminate undesirable image artifacts. These features are not provided by prior art upstream donor guides.

ADVANTAGES

The following are among some of the advantages of this invention:

1. Borderless prints in the print direction are possible because the distance from the electronics package cover to the nip is effectively zero.

2. Scratches on prints from the end of the receiver guide are eliminated because the electronics package cover prevents the receiver from rubbing on the end of the receiver guide.

3. The part count is reduced because the upstream receiver guide of prior art printers is eliminated.

4. Print quality is improved.

5. The electronics package cover provides a loading guide surface for receiver sheets.

6. The electronics package cover provides a rewinding guide surface for receiver sheets.

7. The electronics package cover provides an integral donor guide surface which eliminates the need for additional parts.

8. The electronics package cover provides an integral donor guide surface which centers donor web on the print head and stretches the donor to eliminate image defects.

The invention has been described in detail with particular reference to preferred embodiments thereof, but it will be understood that variations and modifications can be effected within the spirit and scope of the invention.

What is claimed is:

1. A printer adapted to produce an image on a sheet of receiver medium, said printer comprising:

a print head and a platen that together define a print nip;

means defining a path for a sheet of receiver medium, said path leading in a forward direction, to a position at which it proceeds past the nip defined by the head and the platen, said path defining means including a sheet guide disposed along the path;

a transport system (i) for moving the sheet in said forward direction along the paths to the nip until a trailing edge of the sheet has left said sheet guide, whereat an image is produced on the sheet between leading and trailing edges of the sheet and (ii) for moving the sheet in a reverse direction along the path;

a loading guide surface for directing the leading edge of the sheet between the loading guide surface and the platen, toward the nip during an initial loading stage, said loading guide surface terminating short of the nip; and a rewinding guide surface for directing the trailing edge of the sheet from the platen to the sheet guide during movement of the sheet in the reverse direction.

2. A printer as defined in claim 1 wherein the rewinding guide surface is curved.

3. A printer as defined in claim 2 wherein the rewinding guide surface is cylindrical.

4. A thermal printer adapted to transfer an image from a donor web to a sheet of receiver medium, said printer comprising:

a thermal print head and a platen that together define a print nip;

means defining respective paths for the donor web and the sheet, said paths converging in a forward direction, to a position at which they abut, before proceeding past the nip defined by the thermal head and the platen, said paths defining means including a sheet guide disposed along the path for the sheet;

a transport system (i) for moving the donor web and the sheet in said forward direction along their respective paths to the nip until a trailing edge of the sheet has left said sheet guide, whereat heat from the thermal head causes an image to be transferred from the donor web to the sheet between leading and trailing edges of the sheet and (ii) for moving the sheet in a reverse direction along its respective path;

a loading guide surface for directing the leading edge of the sheet between the loading guide surface and the platen, toward the nip during an initial loading stage, said loading guide surface terminating short of the nip; and a rewinding guide surface for directing the trailing edge of the sheet of receiver medium from the platen to the sheet guide surface during movement of the sheet in the reverse direction.

5. A printer as defined in claim 4 wherein the rewinding guide surface is curved.

6. A printer as defined in claim 5 wherein the rewinding guide surface is cylindrical.

7. A printer as defined in claim 4 wherein the loading guide surface is positioned between said converging paths to guide the leading edge of the sheet to the nip.

8. A printer as defined in claim 4 wherein the rewinding guide surface is positioned between said converging paths to guide the trailing edge of the sheet to the sheet guide.

9. A printer as defined in claim 4 further comprising an upstream guide surface for directing donor web toward the nip.

10. A printer as defined in claim 9 wherein the upstream guide surface is curved in a cross-track direction to the path of the donor web to keep the donor web centered in the path.

* * * * *